United States Patent [19]

Luch

[11] 4,101,385

[45] Jul. 18, 1978

[54] PROCESS FOR MAKING A METAL PLASTIC STRUCTURE

[75] Inventor: Daniel Luch, Warwick, N.Y.

[73] Assignee: International Nickel Company, New York, N.Y.

[21] Appl. No.: 779,512

[22] Filed: Mar. 21, 1977

[51] Int. Cl.[2] ..... C25D 5/54; C25D 5/56; C25D 5/34

[52] U.S. Cl. ..... 204/20; 204/30; 204/38 R; 156/150

[58] Field of Search ..... 204/20, 30, 38 E, 22, 204/28, 38 R; 156/150, 278, 280

[56] References Cited

U.S. PATENT DOCUMENTS

| | | | |
|---|---|---|---|
| 2,551,343 | 5/1951 | Scholl | 204/30 |
| 2,551,344 | 5/1951 | Scholl | 204/30 |
| 2,632,722 | 3/1953 | Libberton | 204/6 |
| 2,732,020 | 1/1956 | Scholl | 170/159 |
| 2,776,253 | 1/1957 | Scholl | 204/20 |
| 3,533,921 | 10/1970 | Kalvonjian | 204/38 R |
| 3,865,699 | 2/1975 | Luch | 204/20 |
| 4,009,093 | 2/1977 | Luch | 204/291 |

FOREIGN PATENT DOCUMENTS

| | | | |
|---|---|---|---|
| 534,818 | 3/1941 | United Kingdom | 204/20 |

*Primary Examiner*—T. M. Tufariello

*Attorney, Agent, or Firm*—Ewan C. MacQueen; Francis J. Mulligan, Jr.

[57] ABSTRACT

A process of electroplating aluminum comprising mechanically forming a composite aluminum-platable plastic structure, masking any exposed aluminum and thereafter electroplating the platable plastic surface.

3 Claims, No Drawings

PROCESS FOR MAKING A METAL PLASTIC STRUCTURE

The present invention is concerned with a novel method for electroplating aluminum and a novel aluminum-plastic composite for use in this method.

It is known that the use of aluminum can be advantageous for automobile bumpers because of its light weight. A plain or anodized aluminum bumper is considered by some to be unattractive when compared to the nickel-plated chromium topped steel bumpers which have been conventionally used on automobiles in the United States. While it is possible to electroplate aluminum to provide the so-called "chromium plate" the ordinary way to accomplish this is tedious, expensive and at times gives erratic results. A generalized description of the prior art electroplating of aluminum with nickel prior to a top flash of chromium is set forth in Nickel Plating, Robert Brugger, published by Robert Draper Ltd., Teddington 1970 on pages 319 and 320.

It is an object of the present invention to provide a novel, simple method or process for electroplating aluminum.

Another object of the present invention is to provide a novel aluminum-plastic composite structure for use in the process of the present invention.

Generally speaking, the present invention contemplates mechanically forming a metal, for example aluminum (or other metal corrodable in a metal electroplating bath) solid platable plastic composite, masking any exposed aluminum surface and thereafter electroplating on the solid platable plastic surface.

Platable plastic compositions containing organic resinous materials, carbon black and an effective amount of sulfur are disclosed in U.S. Pat. Nos. 3,865,699, and 4,009,093 and U.S. application No. 735,312. In addition specific highly advantageous compositions of platable plastic based upon polypropylene are currently under test.

In accordance with the invention a polymer-carbon black-sulfur composition is formed into a sheet. The sheet is then mechanically joined for example, by stamping, to a formed aluminum body such as a bumper in the area of the body which is to be plated. The exposed aluminum is masked and the platable plastic surface is then plated with nickel as disclosed in U.S. Pat. No. 3,865,699 etc.

In order to achieve adherence between the aluminum and the platable plastic, it is advantageous to sandblast or otherwise roughen the aluminum surface. Adhesion can also be increased by providing under-cut recesses or holes in the aluminum article into which plastic can be forced under pressure. With some polymer systems, for example, polyvinyl chloride, adhesives are available for joining the plastic and the aluminum.

The process of the present invention is highly advantageous compared to the liquid coating process of plating non-conductive substrates disclosed in U.S. Pat. No. 3,865,699 because it avoids unevenness and flow marks which characterize a dried liquid coating. Further, the present process substantially avoids pollution problems presented by liquid solvents.

A highly advantageous platable plastic composition for use in the present invention comprises in percent by weight about 62% ethylene-propylene copolymer, about 33% carbon black, about 0.7% elemental sulfur, about 0.7% mercaptobenzothiazyl disulfide and about 3% zinc oxide. This composition is melt blended and then sheeted to form sheets having thicknesses in the range of about 100 to 2000 microns ($\mu$) on conventional sheeting equipment. The thus formed sheet is then mechanically applied under heat and pressure with or without a cement to a roughened, formed aluminum or aluminum alloy surface advantageously in such a fashion that the resultant aluminum-platable plastic is mechanically locked together.

After any exposed aluminum is masked, the composite article is then racked for plating with contact being made directly to the platable plastic. The racked article is then employed as a cathode in a nickel plating bath in such fashion that voltage is gradually increased until the whole of the plastic surface is covered with electrodeposited nickel. When this stage has been reached, plating with nickel and chromium or nickel-copper-nickel and chromium or nickel-chromium-nickel and chromium can be carried out essentially in the manner usual to the decorative nickel plating art. With respect to plating on plastic, all of the teachings relative thereto in U.S. patent application Ser. No. 735,212, filed Oct. 26, 1976, are incorporated herein by reference.

EXAMPLE

A formed bumper made of a high strength aluminum alloy is sand blasted to provide, at least on its front a roughened surface. A sheet of polypropylene based, platable plastic containing carbon black and sulfur is then assembled along with the roughened, formed bumper in a stamp press die of bumper configuration with the plastic sheet abutting the front face of the bumper. The plastic and aluminum alloy bumper are then mechanically formed into a composite by operation of the stamp press.

The rear surface of the composite bumper is now masked with a lacquer and then composite bumper is racked for plating. The rack is made a cathode in a Watts-type nickel plating bath and with gradually increasing voltage nickel is deposited to a thickness of about 3$\mu$. The rack is then placed in a bright acid copper bath and about 10$\mu$ of copper is deposited on top of the nickel. This is followed by a bright nickel deposit, topped with a micro-discontinuous deposit of nickel and a final top layer of bright chromium.

The term "aluminum" in this specification and claims includes not only pure aluminum but also wrought and casting aluminum alloys containing more than about 85% aluminum with essentially the remainder of the alloy being selected from the group of silicon, iron, copper, manganesium, chromium, nickel, zinc, titanium and tin. The invention is also applicable to composite structures incorporating metals other than aluminum, for example steel, iron, magnesium and also to non-metallics.

Although the present invention has been described in conjunction with preferred embodiments, it is to be understood that modifications and variations may be resorted to without departing from the spirit and scope of the invention, as those skilled in the art will readily understand. Such modifications and variations are considered to be within the purview and scope of the invention and appended claims.

I claim:

1. A process for electroplating at least part of the surface of a formed body comprising roughening said at least part of said surface, mechanically conforming and adhering a sheet of plateable plastic containing a polymer, carbon black and sulfur to said roughened surface and electroplating said adhered, conformed and plateable plastic sheet.

2. A process as in claim 1 wherein the formed body is a formed aluminum body.

3. A process as in claim 2 wherein the adhered conformed plateable plastic sheet on the formed aluminum body is electroplated with nickel.

* * * * *